US008708020B2

(12) United States Patent
Schütz

(10) Patent No.: US 8,708,020 B2
(45) Date of Patent: Apr. 29, 2014

(54) EMBOSSING DEVICE FOR AT LEAST TWO-LAYERED PLANAR PRODUCTS SUCH AS TOILET PAPER, TISSUES, OR SIMILAR

(75) Inventor: Jürgen Schütz, Horhausen (DE)

(73) Assignee: Metsa Tissue Oyj, Espoo (FI)

( * ) Notice: Subject to any disclaimer, the term of this patent is extended or adjusted under 35 U.S.C. 154(b) by 934 days.

(21) Appl. No.: 12/282,034

(22) PCT Filed: Mar. 7, 2007

(86) PCT No.: PCT/EP2007/001945

§ 371 (c)(1),
(2), (4) Date: Apr. 27, 2009

(87) PCT Pub. No.: WO2007/101668

PCT Pub. Date: Sep. 13, 2007

(65) Prior Publication Data

US 2009/0226670 A1 Sep. 10, 2009

(30) Foreign Application Priority Data

Mar. 8, 2006 (DE) ..... 10 2006 010 709

(51) Int. Cl.
*B31F 1/07* (2006.01)

(52) U.S. Cl.
USPC ..... 156/555; 156/209; 101/23

(58) Field of Classification Search
USPC ..... 156/209, 555, 446, 443; 428/156, 152, 428/166, 178, 172, 153, 154, 161, 163; 101/23
See application file for complete search history.

(56) References Cited

U.S. PATENT DOCUMENTS

| | | | | |
|---|---|---|---|---|
| 5,339,730 | A | 8/1994 | Ruppel et al. | |
| 5,846,636 | A * | 12/1998 | Ruppel et al. | 428/154 |
| 6,106,928 | A * | 8/2000 | Laurent et al. | 428/152 |
| 6,524,683 | B1 | 2/2003 | Roussel et al. | |
| 2005/0098281 | A1 * | 5/2005 | Schulz et al. | 162/117 |
| 2005/0287340 | A1 * | 12/2005 | Morelli et al. | 428/156 |

FOREIGN PATENT DOCUMENTS

| | | | |
|---|---|---|---|
| DE | 69514253 | | 12/1994 |
| DE | 69913122 | | 5/2004 |
| EP | 0738588 | A1 | 10/1996 |
| EP | 1047546 | B1 | 11/2000 |
| EP | 1054764 | B1 | 11/2000 |
| EP | 1096069 | | 5/2001 |
| EP | 0876537 | B1 | 9/2001 |
| EP | 1609589 | | 12/2005 |
| GB | 1225440 | A | 3/1971 |
| WO | WO-9748551 | A1 | 12/1997 |
| WO | WO-99/44814 | | 9/1999 |
| WO | WO-00/78533 | | 12/2000 |
| WO | WO-0073585 | A1 | 12/2000 |
| WO | WO-2005/011970 | | 2/2005 |

* cited by examiner

*Primary Examiner* — Scott W Dodds
(74) *Attorney, Agent, or Firm* — Gifford, Krass, Sprinkle, Anderson & Citkowski, P.C.; Thomas E. Anderson

(57) ABSTRACT

The aim of the invention is to create an embossing device for at least two-layered planar products such as toilet paper, tissues, or similar, which makes it possible to easily make high-quality planar products that are provided with decorative patterns. The aim is achieved by an embossing device for at least two-layered planar products such as toilet paper, tissues, and similar. Also, the embossing device has at least one first and at least one second couple of rollers, each of which is composed of an embossing roller and a squeezer.

10 Claims, 5 Drawing Sheets

EMBOSSING DEVICE FOR AT LEAST TWO-LAYERED PLANAR PRODUCTS SUCH AS TOILET PAPER, TISSUES, OR SIMILAR

CROSS-REFERENCE TO RELATED APPLICATIONS

This application is the U.S. national phase of international patent application PCT/EP2007/001945 filed Mar. 7, 2007, which claims priority to German patent application DE 10 2006 010 709.8 filed Mar. 8, 2006.

FIELD OF THE INVENTION

The present invention relates to an embossing device for at least two-layer planar products such as toilet paper, facial tissues or the like, with at least one first and one second roller couple, each having an embossing roller.

BACKGROUND OF THE INVENTION

Embossing devices of the type mentioned above are known in a great variety from prior art. For example, EP 1 096 069 A2 discloses such an embossing device for producing a multi-layer absorbent paper product with an embossed pattern, wherein each layer is unwound from an unwinding device and supplied to a roller couple consisting of a squeezer and an embossing roller. The respective layer webs are embossed, one of the webs is furnished with glue and, in order to form a so-called "nested" structure, is then run through a nip arranged between two embossing rollers of the roller couples, and the layers are firmly bonded to one another by a downstream joining roller.

There is now an increased need for planar products with two or more layers, particularly those made of tissue or tissue-like materials, such as toilet paper, facial tissue, kitchen towels and the like that bear decorative patterns. It is desirable in this case that the decorative patterns appear very striking and sharp, and that the planar product optionally be given an additional visual effect by means of color.

In the sense of the present invention, tissue is understood to be a product conforming to DIN 6730. According to the latter, tissue is a product that consists entirely or predominantly of cellulose fibers, with a fine and soft creping, which is creped with a dry content of more than 90% in closed formation in the paper machine, consists of one or more layers, is particularly absorptive, has a specific surface weight of less than 5 g/m$^2$ before creping, and a wet elongation of the crepe of greater than 5%.

In the sense of the present invention, tissue-like material is understood to mean a material which, unlike tissue material, is produced by changes in the dry process. According to DIN 6730, tissue-like material is a product predominantly made of cellulose fibers, with large creping and open formation, which is creped dry in the paper machine and consists of one or more layers, wherein the basis weight of a ply before the creping is less than 25 g/m$^2$ and the wet crepe expansion of a ply after creping is greater than 24%. The material can also be produced from old paper.

EP 1 609 589 A2 discloses an imprinted and embossed facial tissue that can be produced with a device consisting of at least two roller couples, comprising an embossing roller, these embossing rollers having embossing points of different heights. A ply is first provided with a micro-embossing when passed through a first roller couple, and subsequently with a motif embossing when passed through a second roller couple.

U.S. Pat. No. 6,106,928 discloses a device in which plies are conducted from an unwinder to a first and second roller couple, wherein embossing rollers comprised by these roller couples have embossing points of a first height and embossing points of a second height and thus embossing points distributed over their entire embossing surface.

It is therefore the problem of the present invention under consideration to provide an embossing device by means of which high-quality planar products, provided with decorative patterns, can be easily produced.

SUMMARY OF THE INVENTION

This problem is solved with an embossing device for at least two-layer planar products, such as toilet paper, facial tissues, and the like.

The present invention has at least one first and at least one second roller couple, formed from an embossing roller and a rubber roller, wherein the embossing roller of the first couple has a large number of embossing points, distributed uniformly over its embossing surface, in a number of approximately 20 to approximately 70 per cm$^2$, preferably, up to approximately 45 per cm$^2$, for the production of a two-dimensional micro-embossing on at least one ply sheet, and wherein the embossing roller of the second couple has first and second areas distributed over their embossing surface, wherein the first areas have a large number of embossing points in a number of approximately 45 to approximately 70 per cm$^2$, to produce a two-dimensional micro-embossing on at least one other ply sheet, and the second areas do not have embossing points, wherein the second areas do not form more than 40% of the entire embossing surface and are not connected with one another.

The present invention has at least one glue application mechanism, which is located adjacent to the embossing roller of the second couple and following the corresponding rubber roller, by means of which glue is applied to the embossing points of the embossing roller.

The embossing rollers of the present invention are located so as to form a nip to conduct together the embossed ply sheets onto one another.

For the formation of a ply bonding of the ply sheets, a bonding roller is located next to the embossing roller of the first couple.

The ply sheets themselves can be formed with one, two, three, or four plies, but also five or six plies. The first and second roller couples can be arranged in any technically possible way. For example, the two roller couples can lie on a common axis and be arranged mirror-symmetrically with respect to one another as mirror images. However, it is also possible, for example, for the rubber roller to be located laterally offset with respect to the embossing roller, and for the other roller couple to be correspondingly arranged mirror-symmetrically such that the two embossing rollers lie in a first plane, and the two squeezers in a second plane offset the first plane. A nip is provided between the two embossing rollers in each case. The embossing device of the invention can moreover comprise two or even three gluing stations and be used for producing at least two-layer, preferably at least three-layer, but also four or five-layer planar products. The individual layers are unwound as webs from unwinding devices, it being possible here as well for the webs to be prefinished in two or even three layers.

The advantageous achievement of the embossing device according to the invention is that, due to the number of embossing points (also called embossing protrusions) provided on the embossing roller of the first roller couple, a sufficient puffiness and softness is imparted to the respective web, i.e., it has higher volume than at least one additional layer web that is embossed by means of the second roller couple. The latter web is furnished with a decorative pattern by the embossing roller of the second roller couple. In this case, a clear representation of the decorative pattern is attained by the higher density of embossing points. The embossing points of the embossing roller providing the decorative pattern to the additional layer web can be arranged linearly and at right angles to one another. The respective rows formed here by the embossing points are offset symmetrically with respect to one another. The decorative pattern is provided by simple omission of the embossing points at the appropriate places. In a particularly preferred design according to the present invention, however, the embossing points are not arranged on the embossing roller linearly, but rather in the form of the pattern itself. Thereby a flower motif, for example, is surrounded by a defined number of embossing points in the shape of a flower, whereby the embossed motif in the finished planar product appears clearer and more distinct to the observer. At the same time, the softness of the product is increased. Not only the decorative motif as a whole, but individual components of it as well, can be surrounded by a solid line of embossing points in the preferred embodiment. The decorative pattern itself can have any type of design; for instance, it can be designed in the shape of a flower, a bird, a heart, etc.

Because at least one gluing station is arranged adjacent to the embossing roller that is to produce the decorative pattern, there is the advantageous effect that the areas of the corresponding layer web having the motif are not provided with glue, since a less clear formation of the embossed motif would thereby result from the joining of the different layer webs. The embossing device of the invention is preferably constructed such that the layer that carries the decorative pattern ends up on an outer side of the formed finished product, it being further preferred that the side of the web that lies directly against the embossing roller of the second roller couple forms an outer side of the planar product.

In a preferred embodiment of the embossing device according to the invention, the gluing station applies colored glue and/or glue mixed with colorant. The procedure can be such that an appropriate colorant is subsequently added to clear or white glue to be used, or a colored glue is directly applied. In this way an additional visual effect is achieved in that the micro-embossed pattern formed by the embossing dots of the embossing roller becomes visible to the observer and the user due to the colored glue. In this manner, a uniform background design is imparted to the planar product, whereby the decorative pattern appears even more distinctly to the observer.

It is further preferable that the squeezers of at least two roller couples have a hardness in the range of roughly 50-70 Shore A. The joining roller can likewise be constructed as a squeezer, preferably furnished with a sleeve. The core of the joining roller here has a hardness in a range of roughly 50 to roughly 70 Shore A, while the sleeve has a hardness in a range of roughly 80 to roughly 100 Shore A. The sleeve can, however, also be formed of a steel jacket. By providing the joining roller with a higher hardness, a secure and uniformly strong connection of the individual layers is achieved. The individual layers of the planar products according to the invention can have, at least in part, a so-called "nested" structure, i.e., elevations achieved by the embossing with the one embossing roller can lie in the depressions obtained in the additional layer web by the second embossing roller. This can happen, in particular, if the density of the embossing points of the first roller and the second roller is roughly equal. Preferably, however, a connection of the individual layer webs is obtained with the invented embossing device such that neither a clearly "nested" structure nor a "tip-to-tip" structure is obtained, i.e., a structure in which the elevations produced by means of the one embossing roller lie against the elevations obtained in the additional layer web by means of the additional embossing roller. In this advantageous configuration, a higher volume of the planar product produced by means of the invented embossing device is achieved. If a layer web already formed of multiple layers is supplied, for example, from an unwinding device as a two or three-layer composite to the embossing device, then this multilayer web can likewise have a "nested" or a "tip-to-tip" structure obtained by a preceding embossing with a third roller couple, but here, too, an irregular joining of the individual layer webs can be provided.

The embossing pressure of the first and second roller couples preferably lies in a range from roughly 4.0 bar to roughly 8.2 bar, preferably roughly 5.7 bar to roughly 6.3 bar. The embossing pressure is modified here by adjusting the squeezer in relation to the embossing roller, with either the squeezer or the embossing roller arranged movably in the embossing device. The embossing pressure is selected with regard to the material in use and the embossed pattern to be obtained. It is fundamental that the embossing points of the embossing rollers penetrate into the softer rubber material of the squeezers.

The line pressure during embossing, both in the micro-embossing and in the decorative pattern, and embossing in combination with a micro-embossing, lies in a range from roughly 15 N/mm to roughly 25 N/mm, preferably up to roughly 20 N/mm. The line pressure is calculated here from the pressure at the pneumatic cylinders of the lower couple multiplied by the length of the lever arm and divided by the embossing width, which is determined by the width of the embossing surface, of the embossing roller.

It is further preferred that the embossing dots or embossing protrusions that are arranged on the embossing roller have a height in a range from roughly 0.7 mm to roughly 1.5 mm, and for the manufacture of facial tissues, a diameter of the embossing surface of the embossing points in a range from roughly 0.35 mm to roughly 0.7 mm, preferably to roughly 0.55 mm. For the manufacture of kitchen towels, particularly in roll form, the embossing dots or embossing protrusions that are arranged on the embossing roller have a height in a range from roughly 1 mm to roughly 1.5 mm, and a diameter of the embossing surface of the embossing points in a range from roughly 1 mm to roughly 1.5 mm, preferably to roughly 1.3 mm, in case of a round construction of the embossing points. In principle, the diameter of the embossing points or protrusions can lie in a range from roughly 0.35 mm to roughly 1.7 mm. In the manufacture of kitchen towels, particularly in roll form, with oval-shaped embossing points or embossing protrusions, the latter have a height in a range from roughly 1 mm to roughly 1.5 mm and a length of the major axis of the embossing point surface in a range from roughly 1.3 mm to roughly 1.7 mm, preferably roughly 1.5 mm, and a length of the minor axis of the embossing point surface in a range from roughly 0.9 mm to roughly 1.3 millimeters, preferably roughly 1.1 mm. The embossing points or protrusions are preferably shaped like a truncated cone and arranged on the surface of the embossing rollers, i.e., the base area there has a larger diameter than the actual embossing surface in the top area. The embossing surface of the top area itself can be rounded or elevated in any other form; however, the embossing surface can also be formed completely flat. The flanks of the embossing points are preferably formed in an angle of roughly 8° to roughly 18° with respect to one another. With such a shaping of the embossing points, it is possible, particularly if they are arranged in the form of the predetermined decorative pattern on an embossing roller, to form the pattern to stand out very sharply. The embossing points or protrusions in the first areas need not necessarily be arranged uniformly on the embossing rollers, but can also be non-uniform, particularly if it is desired to further heighten the visual effect of the decorative pattern obtainable by the second areas. It is particularly advantageous to increase the density of the embossing points of protrusions in the first areas in the direct surroundings of the second areas.

The height of the embossing points or protrusions can preferably also be formed differently. In particular, at least the first line, more preferably the first through fifth lines, even more preferably the first through third lines of embossing points or protrusions surrounding a decorative pattern or lying inside it have a height in a range of roughly 1.0 mm to roughly 1.5 mm, preferably 1.1 to 1.3 mm, while the other embossing points or protrusions arranged in the area between the respective decorative patterns have a height in a range of roughly 0.7 mm to 0.9 mm. With such a design, it is possible to place glue only on those embossing points or protrusions that have the larger height. This has the great advantage of reducing the stiffness of the embossed paper that is obtained. Additionally, an attractive visual effect can be obtained by using a colored glue that is applied only to the embossing points or embossing protrusions with the larger height.

In a preferred embodiment, the joining roller and/or glue application roller is formed in a spiral shape or cylindrically, preferably spiral-shaped. In this way, a further increase in the softness and volume of the manufactured planar product can be achieved.

The embossing rollers are preferably manufactured from steel. The surface of the embossing rollers is produced in a laser process, leaving behind the embossing points in the area of the decorative pattern, or positioning the embossing points directly in the shape of the corresponding decorative pattern. It can also be provided, however, to first manufacture an embossing roller with embossing points arranged at right angles and offset, and then to remove these, at least in part, in the area of the decorative pattern. Parts of the individual embossing protrusions can remain behind so that embossing is performed only by a bisected top surface thereof. The present invention further pertains to an at least two-layer planar product, preferably an at least three-layer, further preferably an at least four-layer planar product, manufactured with an embossing device according to the invention, with at least one layer having a micro-embossing with a number of embossing points in a range of roughly 20 to roughly 70 per $cm^2$, preferably up to roughly 45 per $cm^2$, an at least one additional layer with first and second areas, wherein the first areas have a plurality of embossing points in a number in a range of roughly 45 to roughly 70 per $cm^2$, and the second areas have no embossing points, the second areas covering not more than 40% of the layer surface and not being interconnected. Due to the lack of connection of the second areas among one another, the formation of concrete individual patterns on the planar product becomes possible, and taking into account the surface area of the second areas in relation to the surface area of the first areas, planar products are obtained, which have an outstanding visual effect.

It can preferably be provided that the micro-embossing points of the second layer are formed in color. As already described above, an additional optical effect is achieved thereby. It can additionally be provided that the second layer itself already consists of several individual layers that were supplied to the second roller couple by a common or separate unwinding process. The planar product is preferably constructed as facial tissue, a paper towel, a kitchen towel or toilet paper.

BRIEF DESCRIPTION OF THE DRAWINGS

These and additional advantages of the present invention will be explained in detail with reference to the subsequent figures. Therein.

DETAILED DESCRIPTION OF THE INVENTION

First of all, it should be pointed out that the invention is not limited to the combination of characteristics shown in the individual figures. Rather, the respectively disclosed characteristics in the description, including the description of figures, can be combined with those indicated in the figures.

Figure 1:
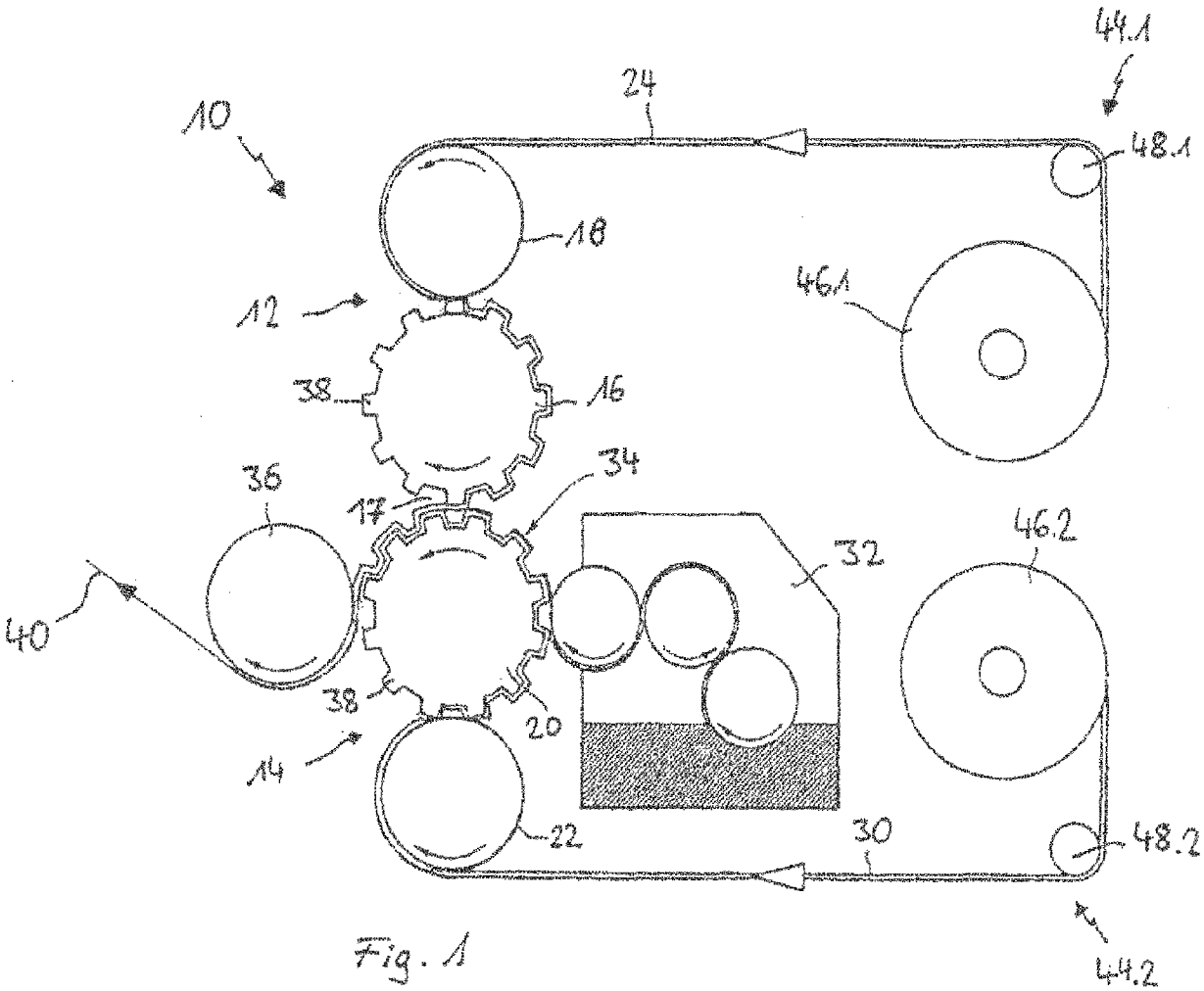
Fig. 1 Prior Art
FIG. 1 shows a schematic view of an embossing device according to the invention, FIG. 2, a view of the surface of the second embossing roller according to FIG. 1.

In a schematic representation, FIG. 1 shows an embossing device labeled with reference number 10 for manufacturing an at least two-layer planar product 40. Therein, at least a first one-layer web 24 is supplied by an unwinding device 44.1, comprising an unwinder 46.1 and a deflection roller 48.1, to a first roller couple 12, which features a squeezer 18 and an embossing roller 16 with embossing points (embossing protrusions) 38. Embossing roller 16 has embossing points arranged uniformly on the surface with a density in a range of roughly 40 points per $cm^2$. The embossing points are preferably arranged with respect to one another in a symmetrical pattern in rows at right angles to one another, wherein the rows are likewise arranged symmetrically offset with respect to one another.

An at least one-layer web 30 is unwound from a second unwinding device 44.2, comprising an unwinder 46.2 and deflection roller 48.2, and supplied to the second roller couple 14 of embossing device 10. Layer web 30 is supplied via a squeezer 22 to embossing roller 20, embossing roller 20 likewise having embossing points 38. Embossing roller 20 is furnished, however, with first and second areas, wherein the first areas impart a micro-embossing to layer web 30, and have embossing points arranged symmetrically or asymmetrically with respect to one another in a density of roughly 60 per $cm^2$. The second areas of embossing roller 20, on the other hand, are formed without embossing points and have the shape of a decorative motif. Following the embossing of the additional layer web 30, the elevations produced by the embossing points 38 are provided with glue 34 by means of gluing station 32. Subsequently, layer web 30 as well as the embossed layer web 24, is supplied via first roller couple 12 and second roller couple 14 to a nip 17, in which the joining of layer webs 24 and 30 takes place. Following this joining, the formed composite is run via second embossing roller 20 to a joining roller 36 ("marriage roll"), which is likewise formed as a squeezer, but with a hardness of the covering of roughly 90 Shore A, differing from the hardness of squeezers 18 and 22 with a value of roughly 60 Shore A. The formed planar product 40 is then led out of the embossing device 10.

A joining of first layer web 24 to additional layer web 30 is shown in FIG. 1 for the sake of simplicity in the form of a so-called "nested" structure. Joining of the individual layer webs can also take place in any other matter, the joining preferably being done in such a manner that neither a purely "nested" structure nor a purely "tip-to-tip" structure is obtained, in order to achieve as high a volume of the produced planar product 40 as possible. Glue is applied in an amount of 0.438 g/cm$^2$ by means of gluing station 32 to the elevations formed by embossing points 38 of second embossing roller 20. A covering degree of embossed layer web 30 of roughly 3.53% relative to the top surface of the individual embossing points is achieved by means of embossing roller 20. By means of first embossing roller 16, a covering degree of roughly 6.8% is achieved.

The distance between the individual embossing protrusions of second embossing roller 20 here was roughly 1.29 mm, whereas the distance between the embossing points 38 of first embossing roller 16 was roughly 1.58 mm.

Figure 2:
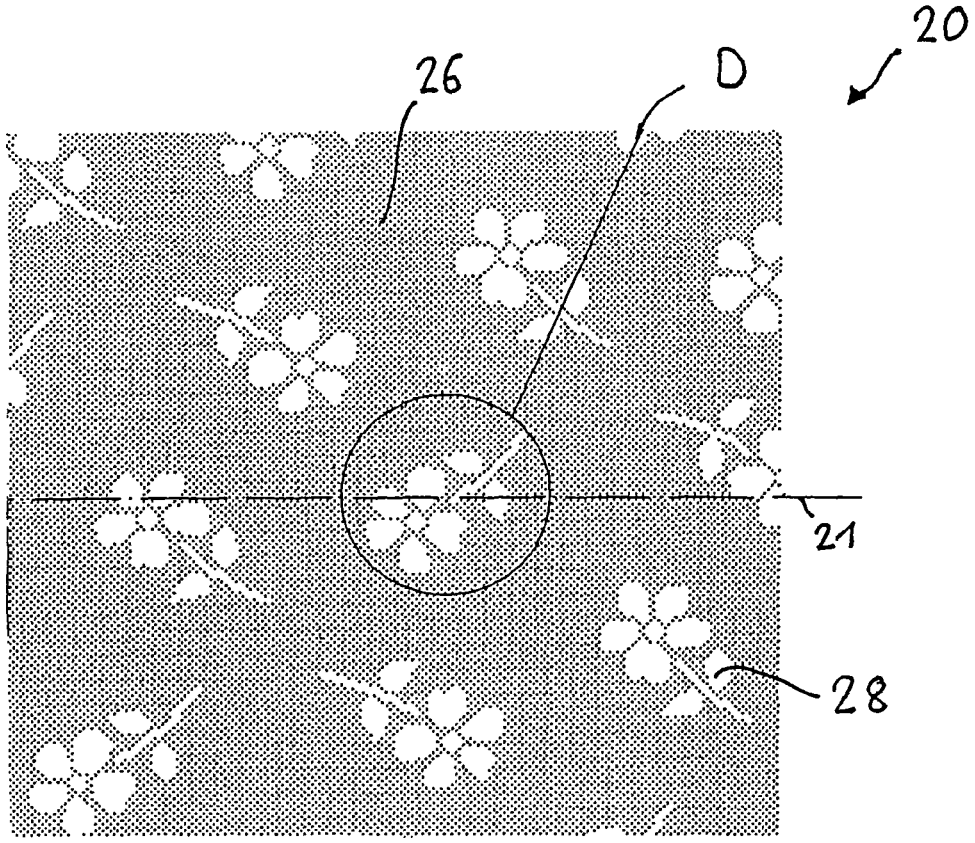

FIG. 2 shows a side view of embossing roller 20, which has a plurality of embossing protrusions. On second embossing roller 20, first areas 26 transforming into one another that surround second areas 28 are formed, these second areas 28 not being interconnected. FIG. 2 shows a front view of the second embossing roller 20 relative to a center axis 21.

Figure 3:
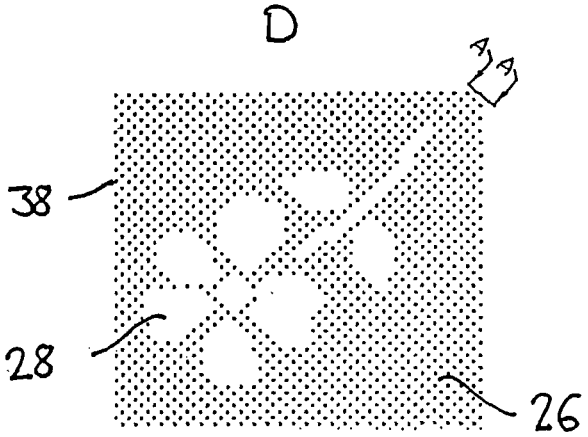
FIG. 3, an enlarged detail view D of FIG. 2.

FIG. 3 shows a detail D of FIG. 2, wherein first areas 26 and second areas 28 are well recognizable. Second area 28 is formed here in the shape of a daisy; first areas 26 have a plurality of embossing points 38 arranged at right angles to one another that are in rows offset relative to one another. In addition, it is appreciated that FIG. 3 teaches that the embossing roller 20 has no embossing points extending across or within the second area 28 and thus no embossing points are located between the one or more first areas 26 that bound the second area 28. Also, the plurality of second areas 28 have one or more shapes that define their own decorative pattern on the embossing roller 20.

Figure 4:
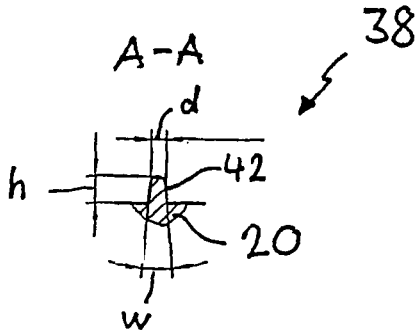
FIG. 4, a view along section A-A of FIG. 3.

FIG. 4 shows, along a section A-A of FIG. 3, the formation of an individual embossing point 38, which is formed in roughly the shape of a truncated cone with flanks 42 that form an angle w of roughly 10° for toilet paper, and of roughly 15° for kitchen towels. Embossing point 38 here is arranged on embossing roller 20. For toilet paper, it has a peak surface in case of a round construction with a diameter d of roughly 0.45 mm and a height h of roughly 0.8 mm, and for kitchen towels, it has a height h of 1.4 mm, for example, and a diameter d of roughly 1.3 mm.

Figure 5:
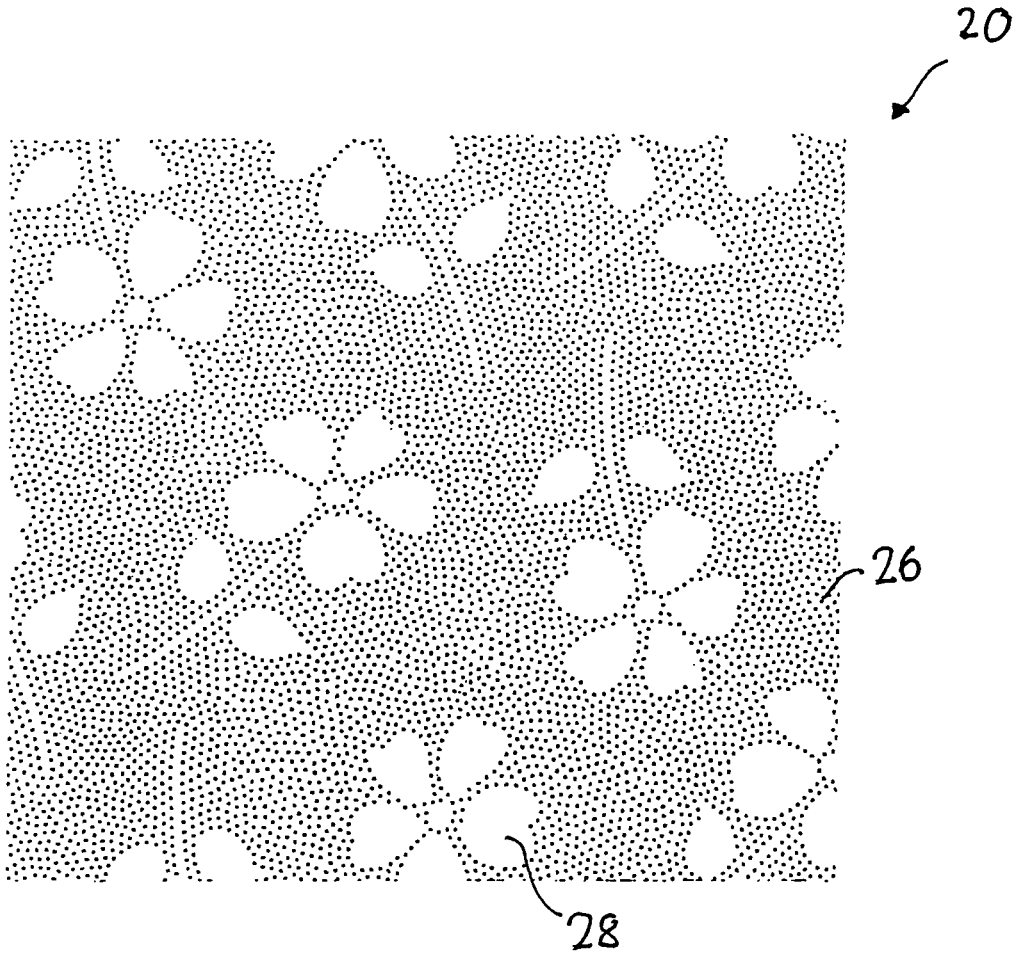
FIG. 5, a view of the surface of an alternatively constructed embossing roller according to FIG. 1, FIG. 6, a view of the surface of an alternatively constructed second embossing roller according to FIG. 1, and FIG. 7, a view of the surface of an additional alternatively constructed second embossing roller according to FIG. 1.

FIG. 5 shows an alternative embodiment of embossing roller 20, wherein second areas 28 here are again in the shape of a flower corresponding to the decorative pattern and free of embossing points, the embossing points being arranged on the surface of embossing roller 20 in the shape of the decor itself. In this way, each sub-area of the entire area 28 is surrounded uniformly by an unbroken line of embossing points, whereby a very marked and beautiful decorative pattern is imparted to the planar product produced by means of embossing device 10. Here as well, first areas 26 are arranged between the individual areas 28 and transition into one another; second areas 28 are not interconnected. The individual embossing points of first areas 26 are arranged, in this case, as uniformly as possible on the surface of embossing roller 20, in order to obtain a relatively uniform overall pictorial appearance, particularly in case of the application of a colored glue. For embossing roller 20 according to FIG. 5, the diameter of the embossing surface on the embossing points 38, namely about 0.5 mm, is somewhat larger than for the embodiment according to FIG. 2.

Figure 6:
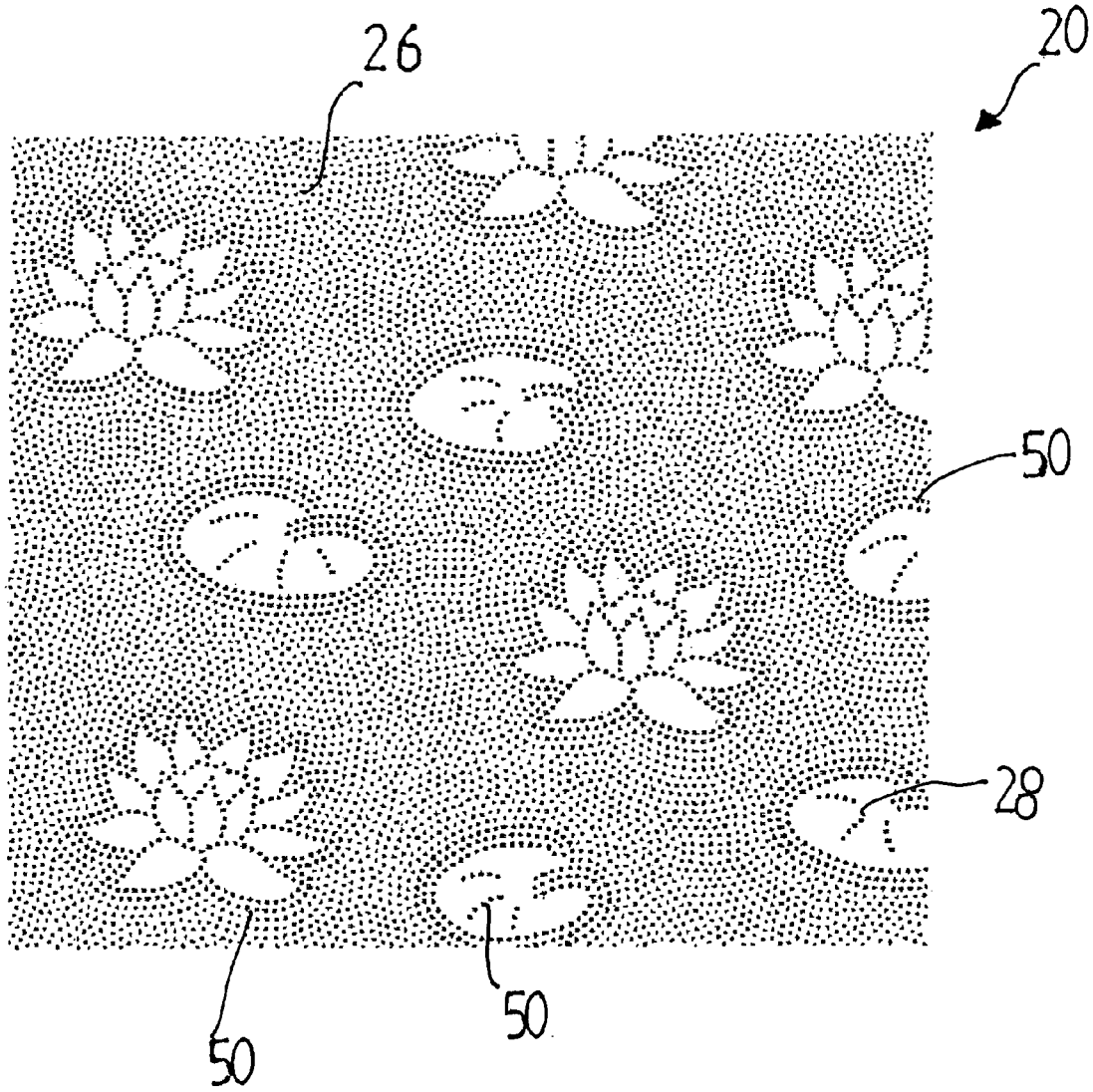

FIG. 6 shows an alternative configuration of the surface of embossing roller 20, which has a plurality of embossing protrusions. This is an alternative construction of the surface shown in FIG. 5. Two or three embossing protrusion rows 50 are arranged here around second areas 28, or an embossing protrusion row 50 is arranged inside second areas 28, these rows having a greater height than the embossing protrusions in first areas 26. Thus, the height of the embossing protrusions, for example, is 0.8 mm in first areas 26, whereas the height of the embossing protrusions in rows 50 is 1.2 mm. In FIG. 6, the difference in height is illustrated by the differing contrast of the embossing protrusions of first areas 26 and those of the embossing protrusions surrounding second areas 28. If, for instance, a colored glue is applied only to rows 50, then a product that has a lower stiffness is obtained, and an attractive visual effect is additionally obtained. As is evident from FIG. 6, it is possible, when a relatively complex pattern is being formed, for the embossing protrusions situated inside a pattern to be elevated, as well as the rows surrounding the pattern, in order to achieve visual effects, particularly if a colored glue is applied.

Figure 7:
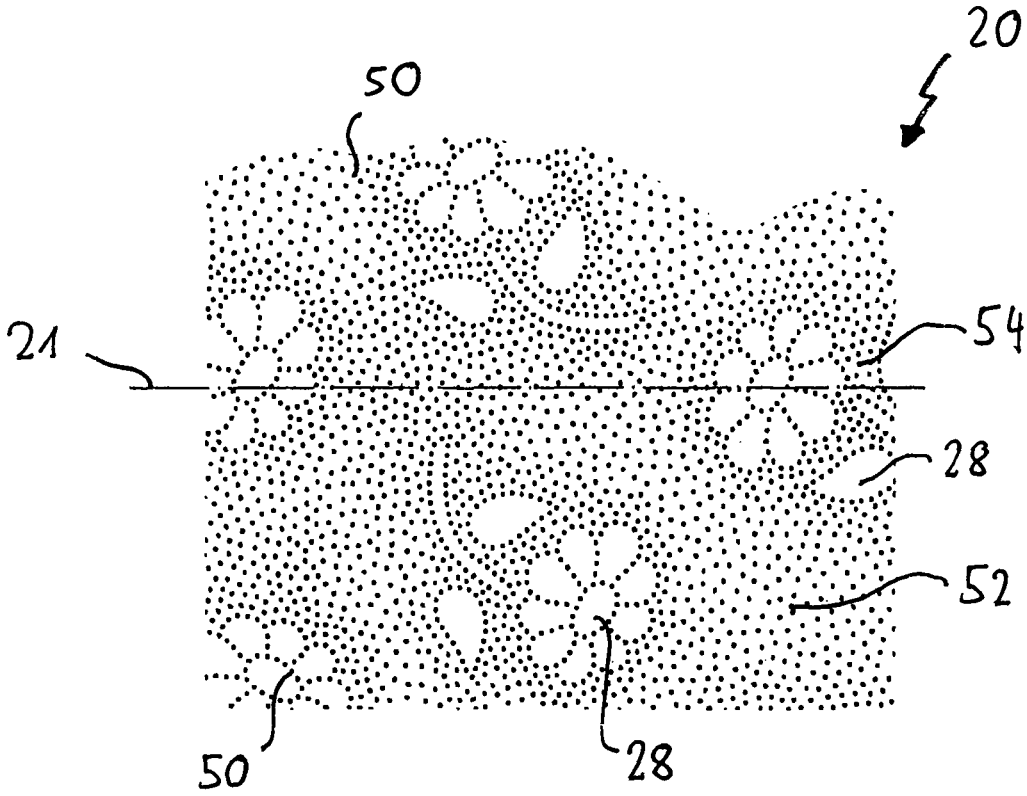

Finally, FIG. 7 shows another alternative configuration of the surface of embossing roller 20, with a center axis 21 that has a plurality of embossing protrusions. Here the second areas 28 have embossing protrusion rows 50 in the interior which, like at least the embossing protrusion rows of first areas 26 in FIG. 6 that are directly adjacent to second areas 28, can have a greater height than the embossing protrusions in first areas 26, so that a beautiful visual effect can be obtained by applying colored glue. First areas 26 have an uneven distribution of the embossing protrusions over the surface of embossing roller 20, their density being higher in the vicinity 54 of second areas 28. In the surface parts 52 that are more distant from second areas 28, on the other hand, first areas 26 have a more uniform distribution of the embossing protrusions.

It is advantageously possible with the embossing device of the invention to impart high-quality embossed patterns easily and without complications to a planar product that is preferably produced from a tissue or tissue-like material in the form of facial tissue, toilet paper, kitchen towels or household towels. Existing embossing devices can be retrofitted with embossing rollers with corresponding parameters. It is to be noted in this regard that, in the sense of the present invention, any arrangement of the respective roller couples with respect to one another is possible, as is the supply of the individual webs to the embossing device separately from several unwinding devices or already as a layer composite.

I claim:

1. An embossing device (10) for at least two-layer planar products (40) such as toilet paper, facial tissue or the like, the embossing device comprising:

at least one first and at least one second roller couple (12, 14), each formed from an embossing roller (16, 20) and a squeezer (18, 22), wherein embossing roller (16) of first couple (12) has a plurality of embossing points (38) uniformly distributed over an entire embossing surface in a number of roughly 20 to roughly 70 per cm$^2$, for producing a two-dimensional micro-embossing on at least one layer web (24), and wherein embossing roller (20) of second couple (14) has an embossing surface with a decorative pattern made from a plurality of first areas (26) having a plurality of embossing points (38) extending across any given first area (26) in a number of roughly 45 to roughly 70 per cm$^2$ to produce a two-dimensional micro-embossing on at least one additional layer web (30) and second areas (28) that have no embossing points extending across any given second area (28), said second areas (28) being formed into one or more shapes so as to form their own decorative pattern on said embossing surface and being bounded by and located within at least one first area (26), and having no embossing points between said at least one bounded first area (26), wherein second areas (28) constitute not more than 40% of the entire embossing surface and are not interconnected, with at least one gluing station (32), which is arranged adjacent to embossing roller (20) of second couple (14) and downstream of the corresponding squeezer (22), and by means of which glue (34) is applied to elevations on the at least one additional layer web (30) produced by the embossing points (38) of embossing roller (20), wherein embossing rollers (16, 20) are arranged relative to one another forming a nip (17) to bring the embossed layer webs (24, 30) together and wherein a joining roller (36) is arranged downstream adjacent to embossing roller (20) of second couple (14) to form a layer connection of layer webs (24, 30).

2. The embossing device according to claim 1, characterized in that the gluing station (32) applies colored glue and/or glue mixed with colorant.

3. The embossing device according to claim 1, characterized in that the squeezers (18, 22) of the first and the second couples (12, 14) have a hardness in a range of roughly 50 to roughly 70 Shore A.

4. The embossing device according to claim 1, characterized in that an embossing pressure of the roller couples (12, 14) lies in a range of roughly 4.0 bar to roughly 8.2 bar.

5. The embossing device according to claim 1, characterized in that a line pressure during embossing by the roller couples (12, 14) lies in a range 15 N/mm to roughly 25 N/mm.

6. The embossing device according to claim 1, characterized in that the embossing points (38) have a height in a range of roughly 0.7 mm to roughly 1.5 mm.

7. The embossing device according to claim 1, characterized in that a diameter of the embossing surface of the embossing points (38) lies in a range of roughly 0.35 mm to roughly 1.7 mm.

8. The embossing device according to claim 1, characterized in that the embossing points (38) are shaped in the form of a truncated cone.

9. The embossing device according to claim 8, characterized in that a plurality of flanks (42) of the embossing points (38) are formed at an angle of roughly 8° to roughly 18° with respect to one another.

10. The embossing device according to claim 1, characterized in that the at least one gluing station is provided with a glue-application roller, and wherein the joining roller (36) and/or the glue-application roller is formed cylindrically or in a spiral shape.

* * * * *

UNITED STATES PATENT AND TRADEMARK OFFICE

CERTIFICATE OF CORRECTION

PATENT NO. : 8,708,020 B2
APPLICATION NO. : 12/282034
DATED : April 29, 2014
INVENTOR(S) : Jürgen Schütz It is certified that error appears in the above-identified patent and that said Letters Patent is hereby corrected as shown below:

On the Title Page, item [30]

Under the Foreign Application Priority Data it lists DE 10 2006 010 709 and it should list DE 10 2006 010 709.8.

Signed and Sealed this
Seventh Day of October, 2014

Michelle K. Lee

Michelle K. Lee
*Deputy Director of the United States Patent and Trademark Office*